US009259827B2

(12) United States Patent
Barsukov et al.

(10) Patent No.: US 9,259,827 B2
(45) Date of Patent: Feb. 16, 2016

(54) APPARATUS FOR HOLDING AND APPLYING TORQUE TO A NUT

(71) Applicant: General Electric Company, Schenectady, NY (US)

(72) Inventors: Mykhaylo Barsukov, Acton, MA (US); Benjamin Edward McDonald, Holliston, MA (US)

(73) Assignee: General Electric Company, Schenectady, NY (US)

( * ) Notice: Subject to any disclaimer, the term of this patent is extended or adjusted under 35 U.S.C. 154(b) by 245 days.

(21) Appl. No.: 14/051,516

(22) Filed: Oct. 11, 2013

(65) Prior Publication Data

US 2015/0101463 A1 Apr. 16, 2015

(51) Int. Cl.

| | |
|---|---|
| ***B25B 23/10*** | (2006.01) |
| ***B25B 13/54*** | (2006.01) |
| ***B25B 15/00*** | (2006.01) |

(52) U.S. Cl.

CPC ..... *B25B 23/108* (2013.01); *B25B 13/54* (2013.01); *B25B 15/004* (2013.01); *B25B 23/105* (2013.01)

(58) Field of Classification Search

CPC .... B25B 23/105; B25B 23/108; B25B 23/08; B25B 15/004; B25B 15/008; B25B 13/54

See application file for complete search history.

(56) References Cited

U.S. PATENT DOCUMENTS

| | | | | |
|---|---|---|---|---|
| 855,280 | A | 5/1907 | Campbell | |
| 1,787,713 | A | 1/1931 | Yungling | |
| 2,302,691 | A | 11/1942 | Green | |
| 2,320,611 | A | 6/1943 | Kandle | |
| 2,802,691 | A | 8/1957 | Barr | |
| 3,774,288 | A | 11/1973 | Kuenzel | |
| 3,844,291 | A | 10/1974 | Moen | |
| 4,007,768 | A * | 2/1977 | Matsushima | 81/448 |
| 4,060,113 | A * | 11/1977 | Matsushima | 81/125 |
| 4,890,521 | A * | 1/1990 | Bien | 81/448 |
| 4,924,736 | A * | 5/1990 | Bonner | 81/448 |
| 6,475,151 | B2 | 11/2002 | Koger et al. | |
| 6,776,762 | B2 | 8/2004 | Erikson et al. | |
| 7,063,666 | B2 | 6/2006 | Weng et al. | |
| 7,103,960 | B2 | 9/2006 | Aime | |
| 7,194,935 | B1 * | 3/2007 | Li | 81/177.85 |
| 7,249,544 | B2 * | 7/2007 | Totsu | 81/452 |
| 7,448,303 | B2 | 11/2008 | Sweat et al. | |

(Continued)

FOREIGN PATENT DOCUMENTS

DE 102006023978 B3 11/2007

OTHER PUBLICATIONS

PCT Search Report and Written Opinion issued in connection with corresponding Application No. PCT/US2014/057941 on Dec. 9, 2014.

*Primary Examiner* — David B Thomas
(74) *Attorney, Agent, or Firm* — Barclay Damon, LLP

(57) ABSTRACT

A tool for holding and applying torque to a nut including a keyway. The tool includes a longitudinal body having a longitudinal axis and a body channel. A longitudinal key is disposed in the body channel with one end of the key configured to engage the keyway of the nut. A first key portion contacts the body channel while a second key portion extends over the body channel forming a gap between the key and the body channel prior to insertion of the key into the keyway of the nut. The second key portion is configured to be resiliently deflected radially inward toward the longitudinal axis of the longitudinal body when the second key portion engages the keyway of the nut.

15 Claims, 7 Drawing Sheets

(56) References Cited

U.S. PATENT DOCUMENTS

| | | | | |
|---|---|---|---|---|
| 7,913,806 | B2 | 3/2011 | Pabon et al. | |
| 8,172,608 | B2 | 5/2012 | Lazenby | |
| 2006/0131906 | A1 | 6/2006 | Maurer et al. | |
| 2008/0215061 | A1 * | 9/2008 | Schumacher et al. | 606/104 |
| 2012/0253355 | A1 | 10/2012 | Murray et al. | |
| 2013/0098167 | A1 | 4/2013 | McDonald et al. | |
| 2013/0219707 | A1 | 8/2013 | Sui et al. | |
| 2014/0083181 | A1 | 3/2014 | McDonald et al. | |
| 2014/0084610 | A1 | 3/2014 | Nguyen | |

* cited by examiner

APPARATUS FOR HOLDING AND APPLYING TORQUE TO A NUT

BACKGROUND OF THE INVENTION

The subject matter disclosed herein relates to an apparatus or tool for holding and applying torque to a nut, e.g., in a sensor port of a flow cell.

Flow meters, including ultrasonic flow meters, employ sensors to determine the characteristics (e.g., flow rate, pressure, temperature, etc.) of liquids, gases, etc. flowing in conduits of different sizes and shapes. Knowledge of these characteristics of the fluid can enable other physical properties or qualities of the fluid to be determined. For example, in some custody-transfer applications, the flow rate can be used to determine the volume of a fluid (e.g., oil or gas) being transferred from a seller to a buyer through a conduit to determine the costs for the transaction, where the volume is equal to the flow rate multiplied by the cross sectional area of the conduit.

A sensor can be installed in a sensor port of a flow cell using an insert body that is mounted within the sensor port. In some installations, the insert body is fixed in the sensor port using threaded nuts that are inserted into the sensor port and tightened proximate to the insert body. In many installations, the significant length of the sensor port requires that the threaded nuts be mounted onto the end of the shaft of a tool, which is extended into the sensor port until the threaded nut reaches the desired installation location. Similarly, when the threaded nuts are removed, the threaded nuts are loosened and removed by the end of the shaft of the tool which is extended into and then pulled back out of the sensor port. Existing tools for accomplishing the insertion and removal of the threaded nuts include ribs on the distal end of a shaft that mate with the keyways of the threaded nuts. When these ribs become worn or otherwise damaged, the tool cannot reliably retain or apply torque to the threaded nut on the end of the shaft, causing the nut to fall off of the shaft of the tool and become lodged in the sensor port. Additionally, given the potential differences in dimensions between different tools and different threaded nuts caused by manufacturing tolerances, the ribs on the shaft do not always reliably retain or apply torque to the threaded nut on the end of the shaft.

The discussion above is merely provided for a general background information and is not intended to be used as an aid in determining the scope of the claimed subject matter.

BRIEF DESCRIPTION OF THE INVENTION

A tool for holding and applying torque to a nut including a keyway is disclosed. The tool includes a longitudinal body having a longitudinal axis and a body channel. A longitudinal key is disposed in the body channel with one end of the key configured to engage the keyway of the nut. A first key portion contacts the body channel while a second key portion extends over the body channel forming a gap between the key and the body channel prior to insertion of the key into the keyway of the nut. The second key portion is configured to be resiliently deflected radially inward toward the longitudinal axis of the longitudinal body when the second key portion engages the keyway of the nut.

In one embodiment, an apparatus for holding and applying torque to a nut comprising a keyway is disclosed. The apparatus includes a longitudinal body comprising a longitudinal axis and a body channel, the body channel comprising a first body channel portion at a first end of the body channel, a second body channel portion at a second end of the body channel, and a channel base surface extending along the length of the body channel and facing radially outward from the longitudinal axis of the longitudinal body. The apparatus also includes a longitudinal key at least partially disposed in the body channel, the longitudinal key comprising a first key portion at the first end of the body channel, a second key portion at the second end of the body channel configured to engage the keyway of the nut, and a key base surface extending along the length of the longitudinal key and facing radially inward toward the longitudinal axis of the longitudinal body. The key base surface of the first key portion contacts the channel base surface and the key base surface of the second key portion extends over the channel base surface forming a gap between the key base surface of the second key portion and the channel base surface prior to insertion of the second key portion into the keyway of the nut. The second key portion is configured to be resiliently deflected radially inward toward the longitudinal axis of the longitudinal body when the second key portion engages the keyway of the nut.

In another embodiment, the apparatus includes a longitudinal body comprising a longitudinal axis and a body channel on an outer surface of the longitudinal body, the body channel comprising a first body channel portion having a first depth at a first end of the body channel, a second body channel portion having a second depth deeper than the first depth at a second end of the body channel, a channel base surface extending along the length of the body channel and facing radially outward from the longitudinal axis of the longitudinal body, and a step formed between the first body channel portion and the second body channel portion. The apparatus also includes a longitudinal key at least partially disposed in the body channel, the longitudinal key comprising a first key portion at the first end of the body channel, a second key portion at the second end of the body channel comprising a chamfered portion configured to engage the keyway of the nut, and a key base surface extending along the length of the longitudinal key and facing radially inward toward the longitudinal axis of the longitudinal body. A collar surrounds the first key portion and radially compresses the first key portion against the first body channel portion. The key base surface of the first key portion contacts the channel base surface and the key base surface of the second key portion extends over the channel base surface forming a gap between the key base surface of the second key portion and the channel base surface prior to insertion of the second key portion into the keyway of the nut. The second key portion is configured to be resiliently deflected radially inward toward the longitudinal axis of the longitudinal body when the second key portion is inserted into the keyway of the nut.

In yet another embodiment, the apparatus includes a longitudinal body comprising a longitudinal axis and a body channel, the body channel comprising a first body channel portion at a first end of the body channel, a second body channel portion at a second end of the body channel, and a channel base surface extending along the length of the body channel and facing radially outward from the longitudinal axis of the longitudinal body. The apparatus also includes a longitudinal key at least partially disposed in the body channel, the longitudinal key comprising a first key portion having a first depth at the first end of the body channel, a second key portion having a second depth shallower than the first depth at the second end of the body channel comprising a chamfered portion configured to engage the keyway of the nut, and a key base surface extending along the length of the longitudinal key and facing radially inward toward the longitudinal axis of the longitudinal body, and a step formed between the base surface of the first key portion and the base surface of the second key portion. A collar surrounds the first key portion and radially compresses the first key portion against the first body channel portion. The key base surface of the first key portion contacts the channel base surface and the key base surface of the second key portion extends over the channel base surface forming a gap between the key base surface of the second key portion and the channel base surface prior to insertion of the second key portion into the keyway of the nut. The second key portion is configured to be resiliently deflected radially inward toward the longitudinal axis of the longitudinal body when the second key portion is inserted into the keyway of the nut.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Differences between otherwise like parts may cause to those parts to be indicated with different numerals. Different parts are indicated with different numerals. Thus, for further understanding of the invention, reference can be made to the following detailed description, read in connection with the drawings in which.

DETAILED DESCRIPTION OF THE INVENTION

Figure 1:
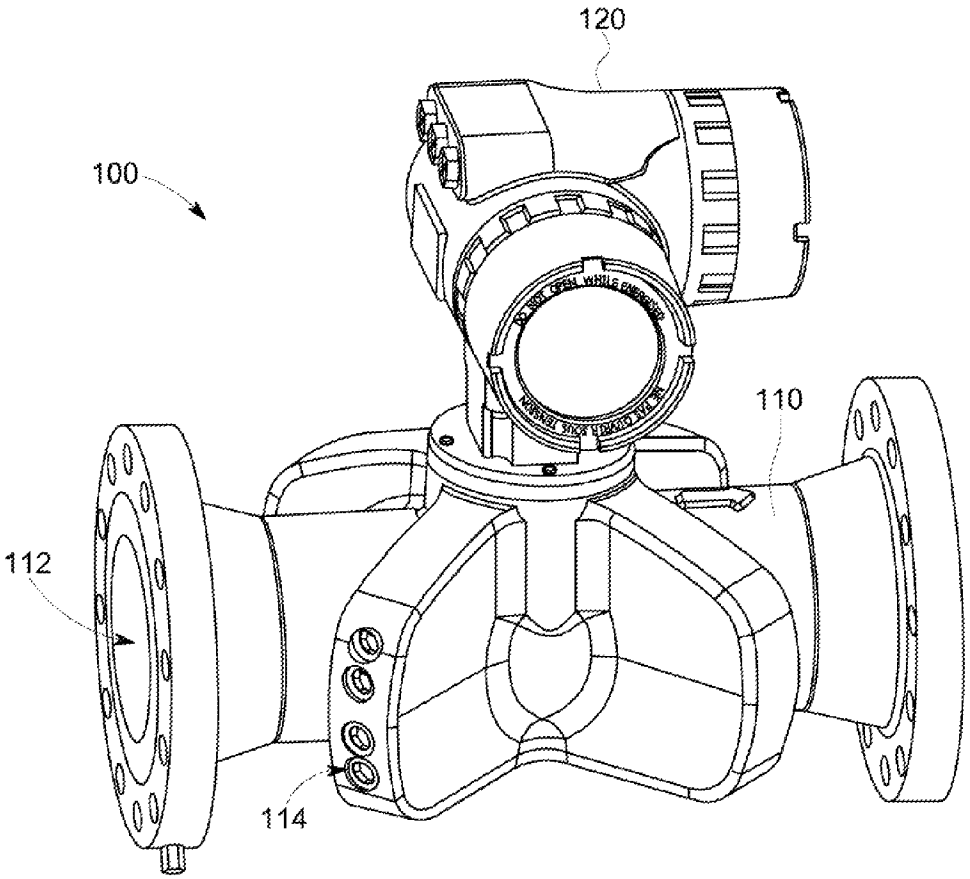
FIG. 1 is a perspective view of an exemplary flow cell apparatus.
Figure 2:
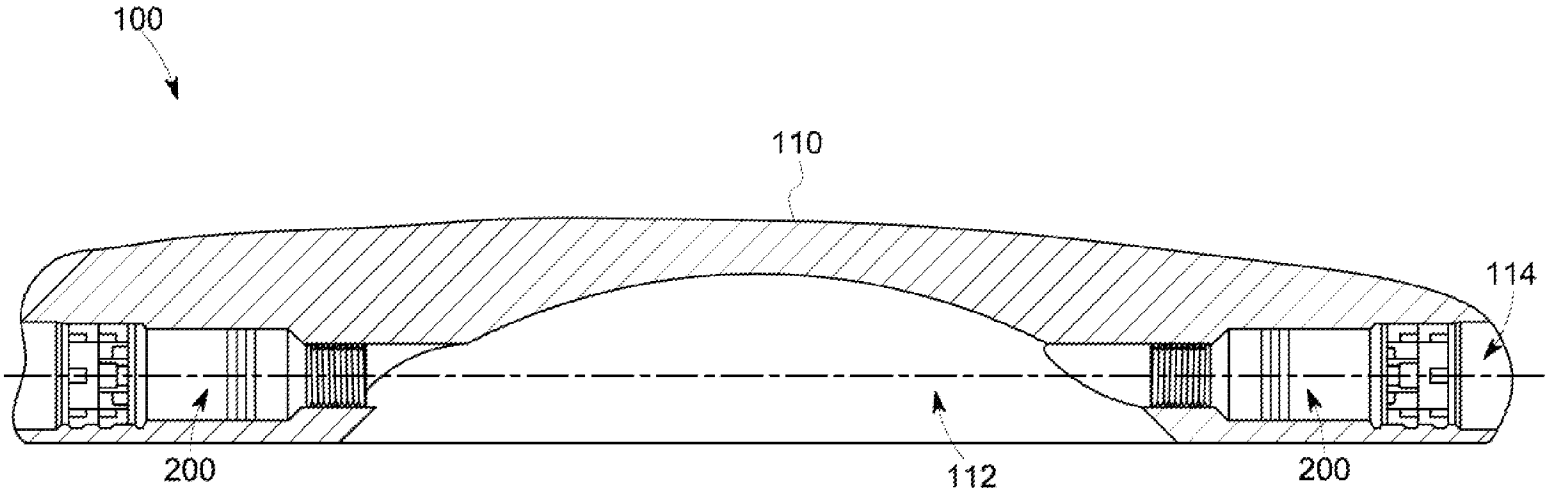
FIG. 2 is a partial cross-section of the exemplary flow cell apparatus of FIG. 1.

FIG. 1 is a perspective view of an exemplary flow cell apparatus 100. FIG. 2 is a partial cross-section of the exemplary flow cell apparatus 100 of FIG. 1. The exemplary flow cell apparatus 100 includes a flow cell 110 having a flow cell bore 112 through which fluid can flow. The flow cell 110 has a plurality of sensor ports 114 in which a sensor port insert apparatus 200 (FIG. 3) is installed. As seen in FIG. 2, the sensor port 114 of the exemplary flow cell 110 is shaped so as to receive and place the exemplary sensor port insert apparatus 200 in physical contact with the fluid in the flow cell bore 112 of the flow cell 110. In one embodiment, where the sensor 230 is an ultrasonic transducer, an ultrasonic signal transmitted from one sensor port insert apparatus 200 travels through the fluid within the flow cell bore 112 and is received by the other sensor port insert apparatus 200. The plurality of ultrasonic transducers are connected to the flow meter 120 to determine the flow rate of the fluid.

Figure 3:
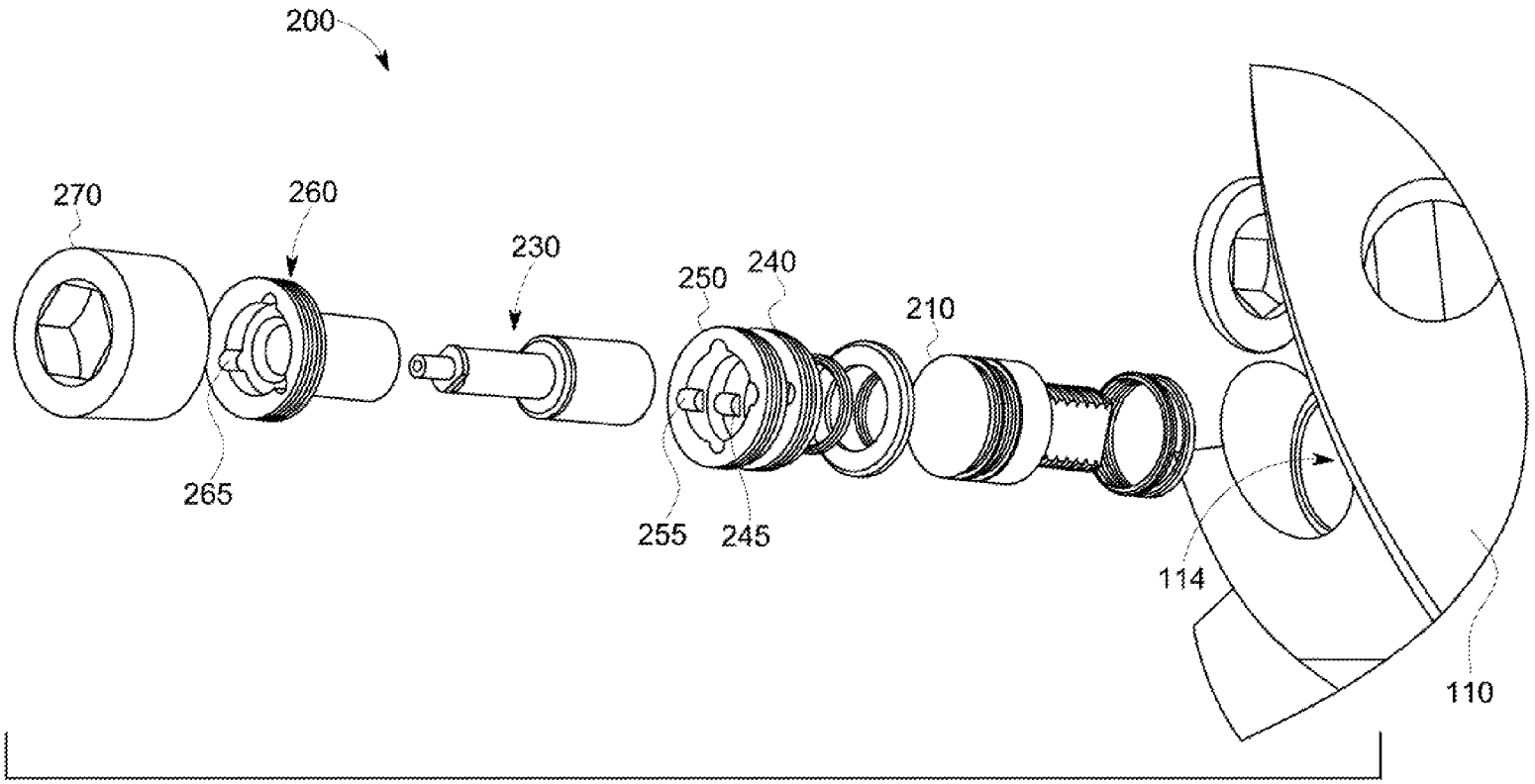
FIG. 3 is an exploded side and perspective view of an exemplary sensor port insert apparatus.

FIG. 3 is an exploded side and perspective view of an exemplary sensor port insert apparatus 200. The sensor port insert apparatus 200 is designed to be installed into the sensor ports 114 of the exemplary flow cell 110 of FIG. 1 to monitor fluid in the flow cell bore 112. In one embodiment, the sensor port insert apparatus 200 includes an insert body 210 configured for insertion into the sensor port 114 of the flow cell 110. The inner surface of the insert body 210 defines a cavity wherein a sensor 230 is located. The insert body 210 is held in place by a first insert body holding nut 240 (e.g., a jamb nut). When the first insert body holding nut 240 is installed and threaded into the sensor port 114, the first insert body holding nut 240 is proximate to and applies a compressive force against the insert body 210. The force applied by the first insert body holding nut 240 to the insert body 210 is sufficient to retain the insert body 210 in the sensor port 114 and withstand pressures created by the fluid in the flow cell. In one embodiment, in order to protect against the possibility of the first insert body holding nut 240 backing out of its installed position, a second insert body holding nut 250 can also be used. When the second insert body holding nut 250 is installed and threaded into the sensor port 114, the second insert body holding nut 250 is proximate to and applies a compressive force against the first insert body holding nut 240. As shown in FIG. 3, the sensor 230 is held in place in the cavity of the insert body 210 by a sensor holding nut 260. In addition, a threaded plug 270 an be used to seal the sensor port 114.

As shown in FIG. 3, the exemplary keyway pattern for the insert body holding nuts 240, 250 includes four keyways (or recesses) 245, 255, equally spaced along one side of the insert body holding nuts 240, 250. The exemplary keyway pattern for the sensor holding nut 260 includes three keyways 265, equally spaced along one side of the sensor holding nut 260. Each of the keyways 245, 255, 265 can be formed as semicircular recesses extending into one side of the nuts 240, 250, 260.

FIGS. 4-9 are perspective views and an illustrative cross-section of an exemplary apparatus (or tool) 300 for holding and applying torque to a nut (e.g., holding nuts 240, 250, 260 in a sensor port 114 shown in FIG. 3). As will be explained and as shown best in FIG. 9, the tool 300 includes a longitudinal body 310 having a longitudinal axis 319 and a body channel 320. A longitudinal key 330 is disposed in the body channel 320 with one end of the key 330 configured to engage the keyway of the nut. A rearward key portion 337 contacts the body channel 320 while a forward key portion 338 extends over the body channel 320 forming a gap between the longitudinal key 330 and the body channel 320 prior to insertion of the longitudinal key 330 into the keyway of the nut. The forward key portion 338 is configured to be resiliently deflected radially inward 361 (FIG. 9) toward the longitudinal axis 319 of the longitudinal body 310 when the forward key portion 338 engages the keyway of the nut. The inventive design allows the longitudinal key 330 or plurality of keys to be spring loaded such that when the longitudinal key 330 resiliently deflects radially inward 361 upon engagement of the keyway of the nut, it applies force on the inside of the keyway to retain the nut on the end of the longitudinal key 330. It will be understood that, while the exemplary tool 300 is shown with three longitudinal keys 330 and channels 320 for engaging with a nut having three keyways (e.g., sensor holding nut 260), the inventive tool 300 can be modified for use with a different number of keys to engage a different number of keyways in a nut (e.g., one or more).

Figure 8:
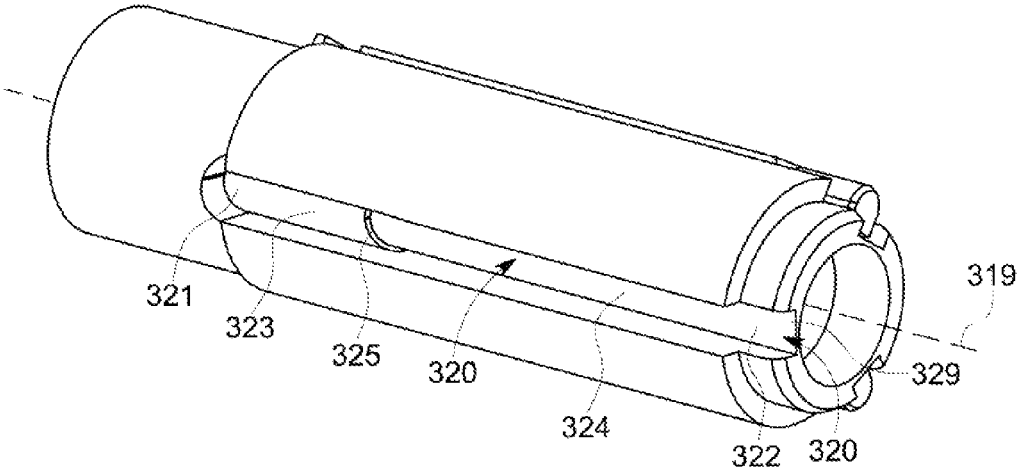
FIG. 8 is a perspective front and side view of the exemplary tool of FIG. 4 with the collar and one of the longitudinal keys removed.
Figure 9:
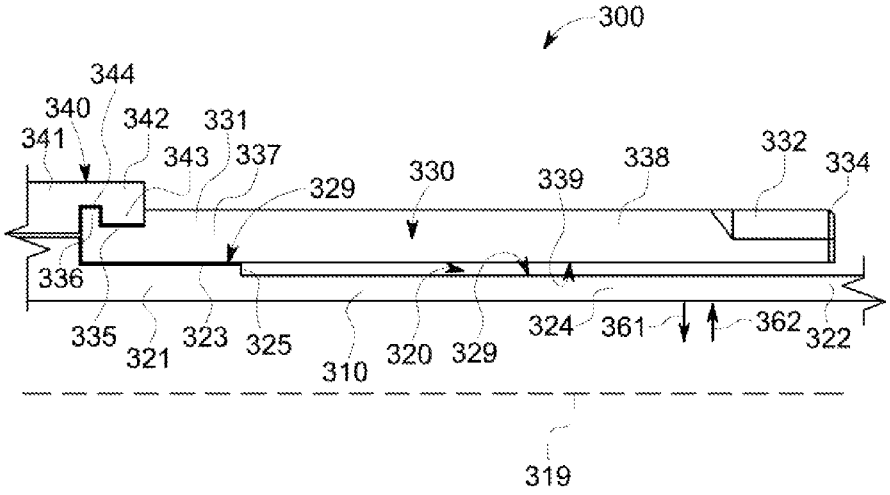
FIG. 9 is an illustrative cross-section of one body channel and longitudinal key in the exemplary tool of FIG. 4.

Returning to FIGS. 4-9, the exemplary tool 300 includes a longitudinal body 310 having a rearward (first) end 311, a forward (second) end 312, a central (third) portion 313, and a longitudinal axis 319. In the exemplary embodiment, the outer diameter of the central portion 313 is greater than the outer diameters of the rearward end 311 and the forward end 312 of the longitudinal body 310. The longitudinal body 310 includes at least one body channel 320 on an outer surface of the longitudinal body 310. As can be seen in FIGS. 8 and 9, the body channel 320 includes a rearward (first) portion 323 at a rearward (first) end 321 of the body channel 320 and a forward (second) portion 324 at a forward (second) end 322 of the body channel 320. The body channel 320 also includes a channel base surface 329 extending along the length of the body channel 320 and facing radially outward 362 (FIG. 9) from the longitudinal axis 319 of the longitudinal body 310. As shown in FIG. 5, the rearward end 311 of the longitudinal body 310 also includes a rear (first) opening 315 configured for receiving a driver tool for applying torque to the longitudinal body 310. The inner surface of the rear opening 315 can include recesses 317 for receiving a pin of the driver tool.

The exemplary tool 300 includes a longitudinal key 330 at least partially disposed in the body channel 320. In one embodiment, the longitudinal key 330 is made of stainless steel. The longitudinal key 330 includes a rearward (first) portion 337 at a rearward (first) end 331 of the longitudinal key 330 and a forward (second) portion 338 at a forward (second) end 332 of the longitudinal key 330. The rearward portion 337 of the longitudinal key 330 is located at the rearward end 321 of the body channel 320 while the forward portion 338 of the longitudinal key 330 is located at the forward end 322 of the body channel 320. The forward portion 338 of the longitudinal key 330 includes a chamfered portion 334 configured to engage the keyway of the nut and resiliently deflect the forward portion 338 of the longitudinal key 330 radially inward 361 toward the longitudinal axis 319 of the longitudinal body 310. As can be seen in FIG. 9, the longitudinal key 330 includes a base surface 339 extending along the bottom of the length of the longitudinal key 330 and facing radially inward 361 toward the longitudinal axis 319 of the longitudinal body 310.

Figure 7:
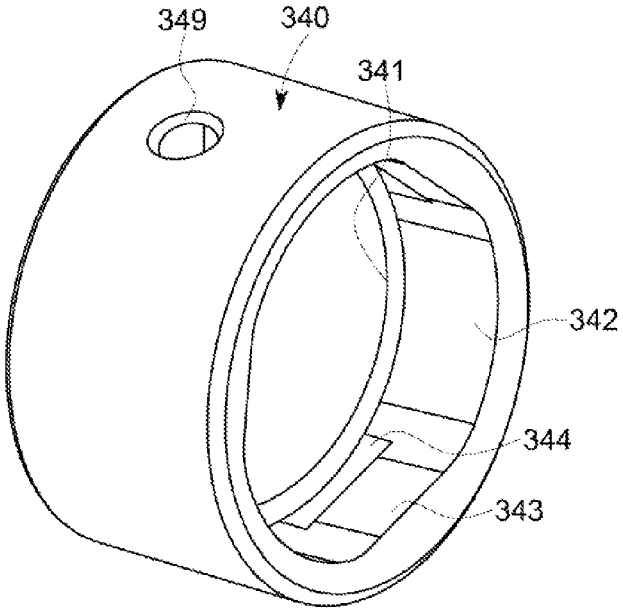
FIG. 7 is a perspective front and side view of the collar of the exemplary tool of FIG. 4.

As can be seen in FIGS. 4, 5, 7, and 9, in one embodiment, the tool 300 includes a collar 340 surrounding the rearward portion 337 of the longitudinal key 330 and radially compressing the rearward portion 337 of the longitudinal key 330 against the rearward portion 323 of the body channel 320. As is best seen in FIG. 7, the collar 340 includes a rearward (first) end 341 and a forward (second) end 342. In one embodiment, the inner diameter and area of the cavity formed by the forward end 342 of the collar 340 is greater than the inner diameter and area of the cavity formed by the rearward end 341 of the collar 340. The forward end 342 of the collar 340 is sized to receive the central portion 313 of the longitudinal body 310, while the rearward end 341 of the collar 340 is sized to receive the rearward end 311 of the longitudinal body 310. A set screw 350 extends through a set screw opening 349 in the collar 340 to retain the collar 340 against the longitudinal body 310 and, as will be explained, retain the longitudinal key 330 in the body channel 320 of the longitudinal body 310.

Figure 6:
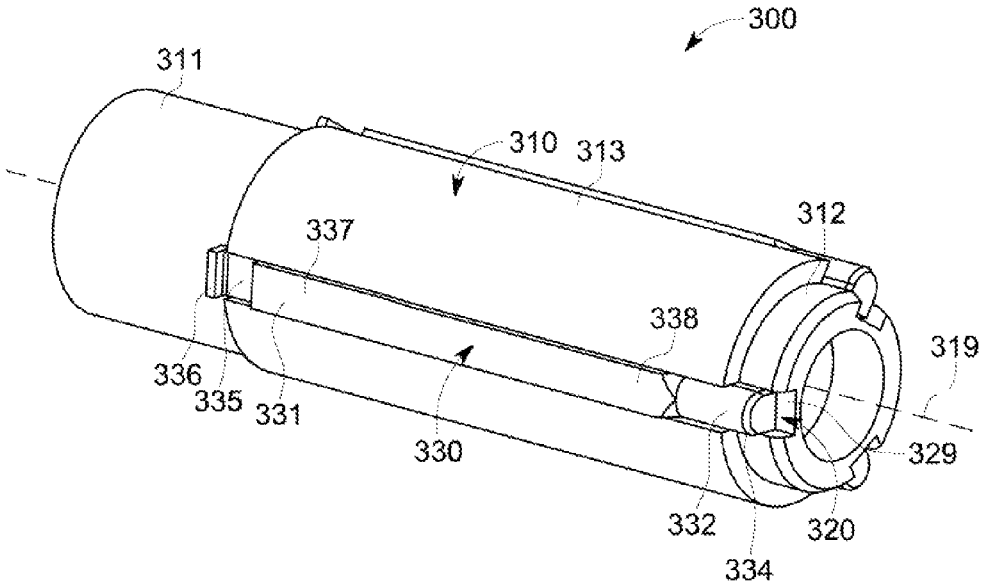
FIG. 6 is a perspective front and side view of the exemplary tool of FIG. 4 with the collar removed.

As can be seen in FIGS. 6 and 9, the rearward portion 337 of the longitudinal key 330 includes a groove 335 and a rib 336 proximate to the groove 335 for engaging with the collar 340. As can be seen in FIGS. 7 and 9, the collar 340 includes a thicker section or protrusion 343 extending from the inner surface of the collar 340 and a recess 344 extending into the inner surface of the collar, the recess 344 proximate to the protrusion 343. As can been seen in FIG. 9, the protrusion 343 of the collar 340 is received by the groove 335 of the rearward portion 337 of the longitudinal key 330 and the rib 336 of the rearward portion 337 of the longitudinal key 330 is received by the recess 344 of the collar 340 to retain the longitudinal key 330 in the body channel 320. In this configuration, the longitudinal key 330 can be removed and replaced when it is worn by removing the collar 340 from the longitudinal body 310.

Figure 4:
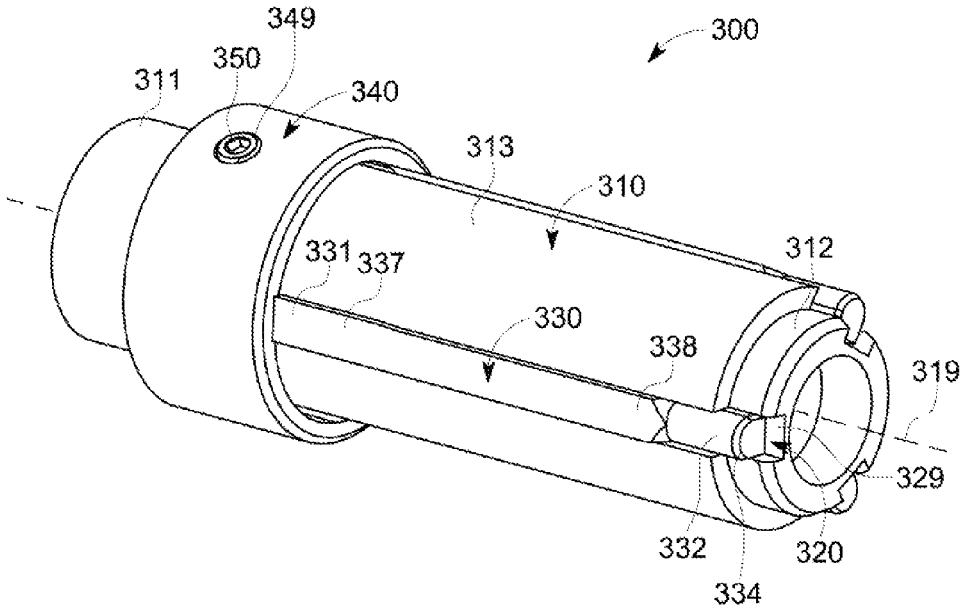
FIG. 4 is a perspective front and side view of the exemplary tool for holding and applying torque to a nut.
Figure 5:
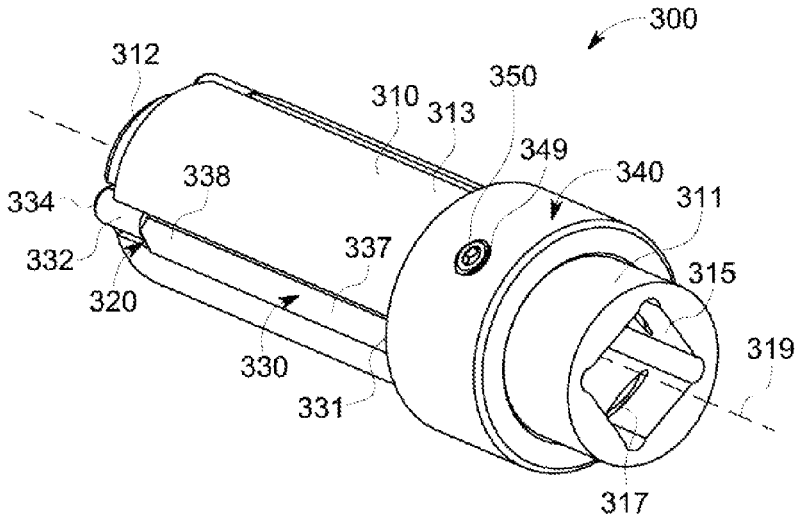
FIG. 5 is a perspective back and side view of the exemplary tool of FIG. 4.

FIG. 9 is an illustrative cross-section of the body channel 320 and longitudinal key 330 in the exemplary tool 300 of FIG. 4. In this embodiment, the resilient spring loading of the longitudinal key 330 is provided by having the longitudinal key 330 extend over two different depths in the body channel 320, creating a pivot under the longitudinal key 330. In the exemplary embodiment, the rearward portion 323 of the body channel 320 has a first depth and the forward portion 324 of the body channel 320 has a second depth deeper than the first depth, such that a step 325 is formed between the rearward portion 323 and the forward portion 324 of the body channel 320.

In this design shown in FIGS. 4-9, the base surface 339 of the rearward portion 337 of the longitudinal key 330 contacts the base surface 329 of the body channel 320 and the base surface 339 of the forward portion 338 of the longitudinal key 330 extends over the base surface 329 of the body channel 320 forming a gap between the forward portion 338 of the longitudinal key 330 and the body channel 320 prior to insertion of the forward portion 338 of the longitudinal key 330 into the keyway of the nut. When the forward portion 338 of the longitudinal key 330 is inserted into the keyway of the nut, the chamfered portion 334 causes the forward portion 338 of the longitudinal key 330 to be resiliently deflected radially inward 361 toward the longitudinal axis 319 of the longitudinal body 310. The forward portion 338 of the longitudinal key 330 extending beyond the step 325 formed in the body channel 320 is forced inward. This resilient deflection applies force on the inside of the keyway to retain the nut on the forward portion 338 of the longitudinal key 330. On the other hand, when the forward portion 338 of the longitudinal key 330 is removed from the keyway of the nut (e.g., after tightening of the nut in the sensor port 114 (FIG. 2)), the forward portion 338 of the longitudinal key 330 is deflected radially outward 362 away from the longitudinal axis 319 of the longitudinal body 310, restoring the resilient spring loading of the longitudinal key 330.

Figure 10:
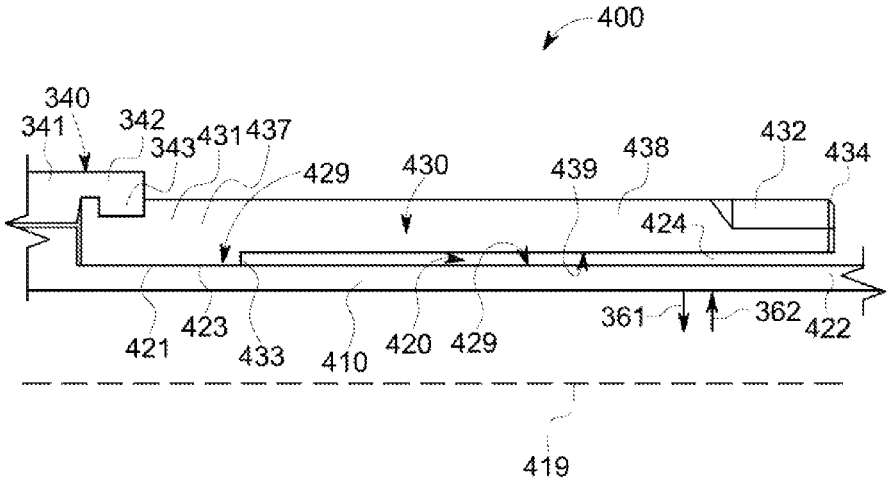
FIG. 10 is an illustrative cross-section of one body channel and longitudinal key in another embodiment.

FIG. 10 is an illustrative cross-section of a body channel 420 and longitudinal key 430 in another embodiment of a tool 400. In this embodiment, the resilient spring loading of the longitudinal key 430 is provided by having a shallower section of the longitudinal key 430 extend over the body channel 420, creating a pivot under the longitudinal key 430. In this embodiment, the rearward portion 437 of the longitudinal key 430 has a first depth and the forward portion 438 of the longitudinal key 430 has a second depth shallower than the first depth, such that a step 433 is formed between the base surface 439 of the rearward portion 437 of the longitudinal key 430 and the base surface 439 of the forward portion 438 of the of the longitudinal key 430.

In this design shown in FIG. 10, the base surface 439 of the rearward portion 437 of the longitudinal key 430 contacts the base surface 429 of the body channel 420 and the base surface 439 of the forward portion 438 of the longitudinal key 430 extends over the base surface 429 of the body channel 420 forming a gap between the forward portion 438 of the longitudinal key 430 and the body channel 420 prior to insertion of the forward portion 438 of the longitudinal key 430 into the keyway of the nut. When the forward portion 438 of the longitudinal key 430 is inserted into the keyway of the nut, the chamfered portion 434 causes the forward portion 438 of the longitudinal key 430 to be resiliently deflected radially inward 361 toward the longitudinal axis 419 of the longitudinal body 410. The forward portion 438 of the longitudinal key 430 extending beyond the step 433 formed in the longitudinal key 430 is forced inward. This resilient deflection applies force on the inside of the keyway to retain the nut on the forward portion 438 of the longitudinal key 430. On the other hand, when the forward portion 438 of the longitudinal key 430 is removed from the keyway of the nut (e.g., after tightening of the nut in the sensor port 114 (FIG. 2)), the forward portion 438 of the longitudinal key 430 is deflected radially outward 362 away from the longitudinal axis 419 of the longitudinal body 410, restoring the resilient spring loading of the longitudinal key 430.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. For example, it will be understood that the spring loading of the longitudinal key 330, 430 can be accomplished using other designs and techniques beyond those disclosed in these exemplary embodiments. Such other examples are intended to be within the scope of the claims if they have structural elements that do not differ from the literal language of the claims, or if they include equivalent structural elements with insubstantial differences from the literal language of the claims.

What is claimed is:

1. An apparatus for holding and applying torque to a nut comprising a keyway, the apparatus comprising:

a longitudinal body comprising a longitudinal axis and a body channel, the body channel comprising a first body channel portion at a first end of the body channel, a second body channel portion at a second end of the body channel, and a channel base surface extending along the length of the body channel and facing radially outward from the longitudinal axis of the longitudinal body;

a set screw extending through the collar to retain the collar against the longitudinal body; and a longitudinal key at least partially disposed in the body channel, the longitudinal key comprising a first key portion at the first end of the body channel, a second key portion at the second end of the body channel configured to engage the keyway of the nut, and a key base surface extending along the length of the longitudinal key and facing radially inward toward the longitudinal axis of the longitudinal body, wherein the key base surface of the first key portion contacts the channel base surface and wherein the key base surface of the second key portion extends over the channel base surface forming a gap between the key base surface of the second key portion and the channel base surface prior to insertion of the second key portion into the keyway of the nut; and wherein the second key portion is configured to be resiliently deflected radially inward toward the longitudinal axis of the longitudinal body when the second key portion engages the keyway of the nut.

2. The apparatus of claim 1, further comprising a collar surrounding the first key portion and radially compressing the first key portion against the first body channel portion.

3. The apparatus of claim 2, wherein the first key portion further comprises a groove and a rib proximate to the groove; and the collar further comprises a protrusion extending from the inner surface of the collar and a recess extending into the inner surface of the collar, the recess proximate to the protrusion, wherein the protrusion of the collar is received by the groove of the first key portion and the rib of the first key portion is received by the recess of the collar to retain the longitudinal key in the body channel.

4. The apparatus of claim 1, wherein the second key portion comprises a chamfered portion configured to engage the keyway of the nut and resiliently deflect the second key portion radially inward toward the longitudinal axis of the longitudinal body when the second key portion engages the keyway of the nut.

5. The apparatus of claim 1, wherein the first body channel portion has a first depth and the second body channel has a second depth deeper than the first depth, wherein a step is formed between the first body channel portion and the second body channel portion.

6. The apparatus of claim 1, wherein the first key portion has a first depth and the second key portion has a second depth shallower than the first depth, wherein a step is formed between the base surface of the first key portion and the base surface of the second key portion.

7. The apparatus of claim 1, wherein the body channel is on an outer surface of the longitudinal body.

8. The apparatus of claim 1, wherein the first end of the longitudinal body comprises an opening configured for receiving a driver tool for applying torque to the longitudinal body.

9. An apparatus for holding and applying torque to a nut comprising a keyway, the apparatus comprising:

a longitudinal body comprising a longitudinal axis and a body channel on an outer surface of the longitudinal body, the body channel comprising a first body channel portion having a first depth at a first end of the body channel, a second body channel portion having a second depth deeper than the first depth at a second end of the body channel, a channel base surface extending along the length of the body channel and facing radially outward from the longitudinal axis of the longitudinal body, and a step formed between the first body channel portion and the second body channel portion, wherein the first end of the longitudinal body comprises an opening configured for receiving a driver tool for applying torque to the longitudinal body;

a longitudinal key at least partially disposed in the body channel, the longitudinal key comprising a first key portion at the first end of the body channel, a second key portion at the second end of the body channel comprising a chamfered portion configured to engage the keyway of the nut, and a key base surface extending along the length of the longitudinal key and facing radially inward toward the longitudinal axis of the longitudinal body; and a collar surrounding the first key portion and radially compressing the first key portion against the first body channel portion, wherein the key base surface of the first key portion contacts the channel base surface and wherein the key base surface of the second key portion extends over the channel base surface forming a gap between the key base surface of the second key portion and the channel base surface prior to insertion of the second key portion into the keyway of the nut, and wherein the second key portion is configured to be resiliently deflected radially inward toward the longitudinal axis of the longitudinal body when the second key portion is inserted into the keyway of the nut.

10. The apparatus of claim 9, wherein the first key portion further comprises a groove and a rib proximate to the groove; and the collar further comprises a protrusion extending from the inner surface of the collar and a recess extending into the inner surface of the collar, the recess proximate to the protrusion, wherein the protrusion of the collar is received by the groove of the first key portion and the rib of the first key portion is received by the recess of the collar to retain the longitudinal key in the body channel.

11. The apparatus of claim 9, further comprising a set screw extending through the collar to retain the collar against the longitudinal body.

12. An apparatus for holding and applying torque to a nut comprising a keyway, the apparatus comprising:

a longitudinal body comprising a longitudinal axis and a body channel, the body channel comprising a first body channel portion at a first end of the body channel, a second body channel portion at a second end of the body channel, and a channel base surface extending along the length of the body channel and facing radially outward from the longitudinal axis of the longitudinal body;

a longitudinal key at least partially disposed in the body channel, the longitudinal key comprising a first key portion having a first depth at the first end of the body channel, a second key portion having a second depth shallower than the first depth at the second end of the body channel comprising a chamfered portion configured to engage the keyway of the nut, and a key base surface extending along the length of the longitudinal key and facing radially inward toward the longitudinal axis of the longitudinal body, and a step formed between the base surface of the first key portion and the base surface of the second key portion; and a collar surrounding the first key portion and radially compressing the first key portion against the first body channel portion, wherein the key base surface of the first key portion contacts the channel base surface and wherein the key base surface of the second key portion extends over the channel base surface forming a gap between the key base surface of the second key portion and the channel base surface prior to insertion of the second key portion into the keyway of the nut, and wherein the second key portion is configured to be resiliently deflected radially inward toward the longitudinal axis of the longitudinal body when the second key portion is inserted into the keyway of the nut.

13. The apparatus of claim 12, wherein the first key portion further comprises a groove and a rib proximate to the groove; and the collar further comprises a protrusion extending from the inner surface of the collar and a recess extending into the inner surface of the collar, the recess proximate to the protrusion, wherein the protrusion of the collar is received by the groove of the first key portion and the rib of the first key portion is received by the recess of the collar to retain the longitudinal key in the body channel.

14. The apparatus of claim 12, further comprising a set screw extending through the collar to retain the collar against the longitudinal body.

15. The apparatus of claim 12, wherein the first end of the longitudinal body comprises an opening configured for receiving a driver tool for applying torque to the longitudinal body.

* * * * *